US009789523B2

(12) United States Patent
Michl

(10) Patent No.: US 9,789,523 B2
(45) Date of Patent: Oct. 17, 2017

(54) MULTI-ROLL TABLE RING-ROLLING MILL AS WELL AS METHOD FOR ROLLING RINGS IN A MULTI-ROLL TABLE RING-ROLLING MILL

(71) Applicant: SMS group GmbH, Duesseldorf (DE)

(72) Inventor: Dennis Michl, Bochum (DE)

(73) Assignee: SMS group GmbH, Duesseldorf (DE)

( * ) Notice: Subject to any disclaimer, the term of this patent is extended or adjusted under 35 U.S.C. 154(b) by 189 days.

(21) Appl. No.: 14/680,261

(22) Filed: Apr. 7, 2015

(65) Prior Publication Data

US 2015/0283592 A1 Oct. 8, 2015

(30) Foreign Application Priority Data

Apr. 8, 2014 (DE) ..... 10 2014 005 085

(51) Int. Cl.
*B21B 37/66* (2006.01)
*B21B 1/16* (2006.01)
(Continued)

(52) U.S. Cl.
CPC ..... *B21B 37/66* (2013.01); *B21B 1/16* (2013.01); *B21B 13/00* (2013.01); *B21B 25/02* (2013.01);
(Continued)

(58) Field of Classification Search
CPC ... G01B 5/00; B21H 1/00; B21H 1/02; B21H 1/06; B21D 51/26; B21D 43/14;
(Continued)

(56) References Cited

U.S. PATENT DOCUMENTS 2,049,202 A * 7/1936 Edelmeier ..... B21H 1/06 72/94
2,928,454 A * 3/1960 Laxo ..... B21D 17/04 72/94
(Continued)

FOREIGN PATENT DOCUMENTS

DE 703 436 C 3/1941
DE 10 98 481 B 2/1961
(Continued)

OTHER PUBLICATIONS

Google Translation from Espacenet of JP 63010033 A.*
(Continued)

*Primary Examiner* — R. K. Arundale
*Assistant Examiner* — Pradeep C Battula
(74) *Attorney, Agent, or Firm* — Collard & Roe, P.C.

(57) ABSTRACT

In a multi-roll table ring-rolling mill and method, a mandrel roll can be switched from a rolling state into a free-running state, when a predetermined ring diameter is reached, even if the roll gap minimum has not yet been reached, in order to improve the size accuracy of the rolled rings. A mandrel roll table rotating about a mandrel table axle is used, along with at least one main roll rotating about a main roll axle and first and second mandrel rolls that are mounted in the mandrel roll table, and a relief device to relieve at least the first mandrel roll of rolling forces. The main roll axle and the mandrel roll table axle are mounted in unchangeable manner and eccentric to one another, at least during the rolling process. The relief device acts independent of the main roll axle and the mandrel roll table axle are eccentric to one another.

26 Claims, 2 Drawing Sheets

(51) Int. Cl.

| | |
|---|---|
| ***B21B 13/00*** | (2006.01) |
| ***B21B 25/02*** | (2006.01) |
| ***B21B 27/02*** | (2006.01) |
| ***B21B 38/04*** | (2006.01) |
| ***B21H 1/06*** | (2006.01) |

(52) U.S. Cl.
CPC ..... *B21B 27/024* (2013.01); *B21B 38/04* (2013.01); *B21H 1/06* (2013.01)

(58) Field of Classification Search
CPC ..... B21D 22/16; B21D 22/18; B21D 17/04; B21B 37/66; B21B 13/08; B21B 13/10; B21B 1/16
See application file for complete search history.

(56) References Cited

U.S. PATENT DOCUMENTS

| | | | | |
|---|---|---|---|---|
| 3,839,887 | A * | 10/1974 | Vieregge ..... | B21H 1/06 72/11.1 |
| 4,326,397 | A | 4/1982 | Strugala et al. | |
| 2009/0120152 | A1 * | 5/2009 | Harrison ..... | B21H 1/12 72/87 |

FOREIGN PATENT DOCUMENTS

| | | | | |
|---|---|---|---|---|
| DE | 11 51 776 | B | | 7/1963 |
| DE | 25 04 996 | A1 | | 8/1975 |
| DE | 25 04 969 | A1 | | 8/1976 |
| DE | 26 15 802 | A1 | | 10/1977 |
| DE | 29 17 369 | A1 | | 11/1980 |
| DE | 10 2011 108 113 | A1 | | 1/2013 |
| JP | S62-244541 | A | | 10/1987 |
| JP | 63010033 | A | * | 1/1988 |
| JP | H06-104258 | B2 | | 12/1994 |

OTHER PUBLICATIONS

European Examination Report dated Sep. 18, 2015 in European Application No. 15160439.4 with English translation of the relevant parts.

Japanese Office Action dated Apr. 19, 2016 in Japanese Application No. 2015-078959 with English translation.

German Examination Report dated Mar. 12, 2015 in German Application No. 10 2014 005 085.8 with English translation of the relevant parts.

* cited by examiner

MULTI-ROLL TABLE RING-ROLLING MILL AS WELL AS METHOD FOR ROLLING RINGS IN A MULTI-ROLL TABLE RING-ROLLING MILL

CROSS REFERENCE TO RELATED APPLICATIONS

Applicant claims priority under 35 U.S.C. §119 of German Application No. 10 2014 005 085.8 filed Apr. 8, 2014, the disclosure of which is incorporated by reference.

BACKGROUND OF THE INVENTION

1. Field of the Invention

The invention relates to a multi-roll table ring-rolling mill that comprises at least one main roll and two mandrel rolls, which are mounted in a mandrel roll table that rotates about a mandrel roll table axle, wherein the main roll rotates about a main roll axle, and the main roll axle and the mandrel roll table axle are mounted in unchangeable manner and eccentric to one another, at least during the rolling process. Likewise, the invention relates to a method for rolling rings in a multi-roll table ring-rolling mill, in which at least two mandrel rolls mounted in a mandrel roll table rotate about a main roll, wherein a roll gap formed between the mandrel rolls and the main roll, in each instance, is reduced as a function of the angular position of the mandrel roll table that exists with reference to the main roll, down to a roll gap minimum, and subsequently increased again.

2. Description of the Related Art

There are ring-rolling mills in different sizes, whereby for very large rings, a main roll and a mandrel roll are generally pressed against one another, and the ring to be rolled circulates in the roll gap situated between these two rolls. Depending on the specific requirements, axial rolls and/or further special rolls are also provided in the case of very large ring-rolling mills. In this connection, the rolling process as well as the degrees of deformation can be selected relatively freely, because ultimately, the ring can be passed through the respective roll gaps as often as desired. Such ring-rolling mills have a relatively complex construction, however, and are therefore cost-intensive, whereby the method sequence can also be complex and, in particular, very time-consuming. Such ring-rolling mills are known, for example, from DE 25 04 969 A1 or from DE 10 2011 108 113 A1.

Multi-roll table ring-rolling mills in which at least two, generally however at least four, mandrel rolls are mounted on a mandrel roll table that can rotate about a main roll can achieve significantly higher throughput. Such an arrangement is disclosed, for example, in DE 26 15 802 A1, in which, because of the placement of multiple mandrels on a mandrel roll table, each individual rolling process, however, can be configured individually for each of the rings, corresponding to the ring-rolling mills described above, by means of individual placement of the respective mandrel roll with reference to the main roll. Because of the mandrel roll table, the feed of rings to be rolled or ring blanks and the discharge of the rolled rings can be significantly accelerated and integrated into the rolling process.

Very high production speeds are allowed by multi-roll table ring-rolling mills such as those disclosed in DE 10 98 481 B, for example, whereby the multi-roll table ring-rolling mill presented there comprises a main roll and four mandrel rolls, which are mounted in a mandrel roll table rotating about a mandrel roll table axle, and whereby the main roll rotates about a main roll axle, and the main roll axle and the mandrel roll table axle are mounted in unchangeable manner and eccentric to one another, at least during the rolling process, and a roll gap formed is reduced down to a roll gap minimum, solely by means of changing the angular position of the mandrel roll table with reference to the main roll. After having passed through the roll gap minimum, the roll gap increases again, so that the rolling process is then completed. For refitting purposes, it is possible to change the location of the mandrel rolls on the mandrel roll table of DE 10 98 481 B. As DE 26 15 802 A2 also emphasizes in its discussion of DE 10 98 481 B, however, unavoidable variations in the insertion volume of the ring blanks or of the rings still to be rolled directly lead to variations in the diameter and the height, which then leads to extraordinarily complicated production systems, because generally calibration presses for the diameter, and frequently even further calibration presses for the required ring height have to be added subsequently.

SUMMARY OF THE INVENTION

It is an object of the present invention to make available a multi-roll table ring-rolling mill of the stated type as well as a method of the stated type, for rolling rings in a multi-roll table ring-rolling mill, in which sufficient size accuracy of the rings produced can be guaranteed, in structurally simple manner.

These and other objects are accomplished by a multi-roll table ring-rolling mill and by a method for rolling rings in a multi-roll table ring-rolling mill, having the characteristics according to the invention. Further embodiments, which can be advantageous even independent of these characteristics, are found below.

Thus, in order to guarantee sufficient size accuracy of the rings produced, in structurally simple manner, a multi-roll table ring-rolling mill that comprises at least one main roll and two mandrel rolls that are mounted in a mandrel roll table that rotates about a mandrel roll table axle and in which the main roll rotates about a main roll axle, and the main roll axle and the mandrel roll table axle are mounted in unchangeable manner and eccentric to one another, at least during the rolling process, can be characterized in that the multi-roll table ring-rolling mill has relief means for relieving at least one of the mandrel rolls of rolling forces. Such relief means act independent of the eccentricity of the main roll axle and the mandrel roll table axle. Such relief means make it possible, in a suitable embodiment, to interrupt a rolling process independent of the angular position of the mandrel roll table with reference to the main roll, so that in this way, it is possible to act on the size accuracy of the rolled ring, in each instance, in targeted manner.

In this connection, it is understood that the time point or the angular position of the mandrel roll table, at which the relief means then act with a relieving effect, can be established according to different criteria. For example, it is possible that the volume of the blank used is determined in advance, and an angular position or time point at which relief is supposed to start is established on the basis of the volume. Likewise, it is understood that other criteria, such as the ring diameter or also the thickness of a ring, for example, can be measured directly, in order to obtain a corresponding criterion in this way.

In particular, in order to guarantee sufficient size accuracy of the rings produced, in structurally simple manner, a multi-roll table ring-rolling mill is accordingly advantageous, even independent of the other characteristics of the present invention, that comprises at least one main roll and two mandrel rolls that are mounted so as to rotate about a mandrel roll table axle, in which the main roll rotates about a main roll axle, and the main roll axle and the mandrel roll table axle are mounted in unchangeable manner and eccentric to one another, at least during the rolling process, and which is characterized in that the multi-roll table ring-rolling mill has measurement means for measuring a ring diameter of a ring situated and being rolled between a mandrel roll and a main roll.

By means of corresponding measurement means, in particular, it is possible to respond to the respective rolling process in targeted manner, particularly also before any calibration pressing or other subsequent working, whereby of course it appears particularly practical to couple the relief means explained above with these measurement means, under some circumstances.

On the other hand, other measures that influence size accuracy, as a reaction to these measurements, are also conceivable, such as, for example, adapting the eccentricity between main roll axle and mandrel roll table axle.

Accordingly, it is particularly advantageous if the multi-roll table ring-rolling mill comprises not only the relief means described above but also the measurement means described above. In particular, the measurement means can be connected to act together with the relief means, in such a manner that the relief means relieve a mandrel roll when a specific ring diameter has been reached. For this purpose, it is particularly possible to predetermine the specific ring diameter, and to produce a signal by way of a reference/actual comparison of the measurement result from the measurement means with the previously input reference value for the specific ring diameter. This signal triggers a relief procedure for a specific mandrel roll. By an action connection directed at a specific ring diameter, coupling of the relief means with the measurement means can be implemented in particularly simple structural manner, for example in that a lever, button or switch is directly activated by the ring at a specific ring diameter.

Preferably, the measurement means are disposed on the mandrel roll table, so that precise measurement is possible independent of the speed at which the angular position of the mandrel roll table changes.

In particular, a measurement means can be provided per mandrel roll, so that individual control is made possible for each mandrel roll individually or for each individual rolled ring. It is understood that cumulatively or alternatively to this arrangement, corresponding relief means can also be provided, preferably per mandrel roll.

As already indicated above, different or different types of measurement devices can be used as measurement means. For example, a scale can already serve as a measurement means, if, for example, the volume used is to be utilized as a criterion as to the angular position or time point from which relief is supposed to take place.

Likewise, cameras are also possible, with which the entire mandrel roll table and all the rings situated on it can be observed, whereby then, the corresponding criteria are analyzed and evaluated by way of image analysis. Likewise, for example, optical distance measurements for determining the ring diameter are easily possible, whereby such optical distance measurement devices are preferably disposed on the mandrel roll table and rotate with the mandrel rolls.

Instead of optical distance measurement devices, however, mechanical or electrical contacts can also be provided, by means of which ring diameters can be determined and an end of the rolling process can be initiated. Such mechanical or electrical contacts, such as, for example, also levers, buttons or switches, can particularly be set at predeterminable positions on the mandrel roll table, so that when a ring reaches these switches, the rolling process can then be ended accordingly.

It is understood that all other measurement devices with which relevant criteria for ending the rolling process can be determined using measurement technology, can be used accordingly. For example, inductive measurements or even acoustical measurements can be used accordingly, if applicable.

It is understood that if the ring diameter is used as a criterion, the outside ring diameter or the inside ring diameter, if applicable also a center diameter or other variables that can be defined as a diameter, can be used as a criterion. Ultimately, this use depends on the desired type of size accuracy and the possibilities of determining it using measurement technology.

The relief means can comprise a releasable mandrel roll lock of the respective mandrel roll on the mandrel roll table, thereby making it possible to guarantee relief in structurally simple manner, because then, the mandrel roll can be released, and no rolling forces can be applied any longer when the mandrel roll lock is released. For example, it is conceivable to guide the mandrel roll in an oblong hole when the mandrel roll lock is released, whereby the mandrel roll lock can press the mandrel roll against an end of the oblong hole when the mandrel roll is locked in place by it. Accordingly, the mandrel roll lock then absorbs the rolling forces; when the mandrel roll lock is released, this absorption is no longer possible, so that the rolling process is ended.

Cumulatively or alternatively to the release mandrel roll lock, the relief means can comprise displacement means for displacing a mounting of the respective mandrel roll on the mandrel roll table. A very slight displacement of a mandrel roll away from the main roll already ends a respective rolling process. Such displacements can also be implemented by a motor, for example. Likewise, such a displacement can then also take place mechanically, in that when a specific ring diameter is reached, a mechanical lever is pushed outward by the ring, which ultimately presses outward, following the eccentricity between main roll and mandrel roll table, and in this way releases the mandrel roll lock and, at the same time, exerts a force in the mandrel roll radially outward. If necessary, the energy present in the rotating mandrel roll table or from the rotating main roller can also be utilized for this movement, in that corresponding gear mechanisms go into effect when the corresponding criterion, such as reaching the specific ring diameter, has been fulfilled.

Accordingly, motors or other actuators can be used as displacement means. In this regard, electric motors or electrically operated actuators specifically appear to be advantageous as displacement means. Levers or lever arrangements or other gear mechanisms that are driven by means of moments or forces of the multi-roll table ring-rolling mill and are merely turned on when the predetermined ring diameter is reached, in particular, are possible as mechanical displacement means, whereby the latter can also take place purely mechanically or, once again, by means of an actuator or motor, or also spring arrangements that are biased, for example, are possible. In this connection, the displacement means, particularly if they comprise motors or actuators directly, can comprise further gear mechanism elements, such as, for example, an eccentric mounting of the mandrel rolls on an eccentric device that in turn is seated on a motor shaft, or mounting of the mandrel rolls in a motor-driven lever or a lever driven by way of an actuator or on a linear drive possible.

Preferably, the multi-roll table ring-rolling mill has return means for returning the mandrel roll from a release position in which it is relieved into a rolling position in which it can encounter rolling forces once again, whereby the return means are preferably provided in an angular position range of the mandrel roll table, in which the respective mandrel roll is not stressed with rolling forces. In this manner, the rolling forces do not also have to be overcome for a return.

Of course, any displacement means, such as electrical motors or the like, can serve as return means. On the other hand, for example, merely a slant can also be provided, past which the mandrel roll is moved while the mandrel roll table rotates about the main roll, and which slant is disposed in such a manner that a mandrel roll situated in a release position is guided back into its rolling position by the slant.

It is understood that the return means can also lock a mandrel roll lock again, if applicable, to the extent that this lock does not lock automatically, for example by means of a snap connection, when a mandrel roll gets into the rolling position.

Sufficient size accuracy of the rings produced can also be guaranteed, in structurally simple manner, by means of a method for rolling rings in a multi-roll table ring-rolling mill, in which at least two mandrel rolls mounted in a mandrel roll table rotate about a main roll, wherein a roll gap formed between the mandrel rolls and the main roll, in each instance, is reduced as a function of the angular position of the mandrel roll table that exists with reference to the main roll, down to a roll gap minimum, and subsequently increased again, and wherein the method is characterized in that when a predetermined ring diameter is reached, a corresponding mandrel roll is switched from a rolling state into a free-running state, even if the roll gap minimum has not yet been reached.

In this connection, it is understood that the angular position of the mandrel roll table must ultimately be positioned with reference to the main roll axle, in other words with reference to a coordinate system that does not rotate along with the main roll, or alternately with reference to the mandrel roll table axle. Thus, the eccentricity between main roll axle and mandrel roll axle mentioned above causes a respective roll gap between mandrel roll and main roll to change periodically, automatically, for example, and to vary between a minimum and a maximum. This change is directly proportional to the angular position and in a fixed functionality with it. In this connection, this eccentricity is interrupted when a corresponding mandrel roll is switched from a rolling state into a free-running state when a predetermined ring diameter has been reached, because then, this predetermined roll gap minimum is no longer reached for this pass.

To switch the mandrel roll from a rolling state into a free-running state, the roll gap of the corresponding mandrel roll can be opened. This switch directly brings about an end of the respective rolling process.

Likewise, a rolling process ends if the corresponding mandrel roll is relieved of the rolling force and the mandrel roll is switched from the rolling state into the free-running state in this manner.

In order to be able to proceed continuously, a mandrel roll, after having been switched into the free-running state, is preferably switched back into the rolling state before the start of the next rolling process with this mandrel roll. Alternatively, it would be conceivable to carry out a switch into the rolling state also during the rolling process, but this switch would then have to take place counter to the rolling forces and would be correspondingly complicated. If the return to the rolling state takes place before the start of the next rolling process, no rolling forces have to be overcome yet, accordingly.

To switch the mandrel roll from the rolling state into the free-running state, the respective mandrel roll can be displaced, with reference to the mandrel roll table, from a rolling position into a release position that is farther away from the main roll than the rolling position. This displacement results in very simple structural implementation for opening of the roll gap and relief of the corresponding mandrel roll.

After displacement from the rolling position into the release position, this mandrel roll is preferably displaced back into the rolling position, so that it is possible to proceed further continuously. As has already been explained above, this return displacement preferably takes place before the beginning of the next rolling process with this mandrel roll, because then, return displacement does not have to take place counter to the rolling forces.

It is understood that the characteristics of the solutions described above and in the claims can also be combined, if applicable, in order to be able to implement the advantages cumulatively, accordingly.

BRIEF DESCRIPTION OF THE DRAWINGS

Further advantages, goals, and properties of the present invention will be explained using the following description of exemplary embodiments, which are particularly also shown in the attached drawing. The drawing shows.

DETAILED DESCRIPTION OF PREFERRED EMBODIMENTS

Figure 1:
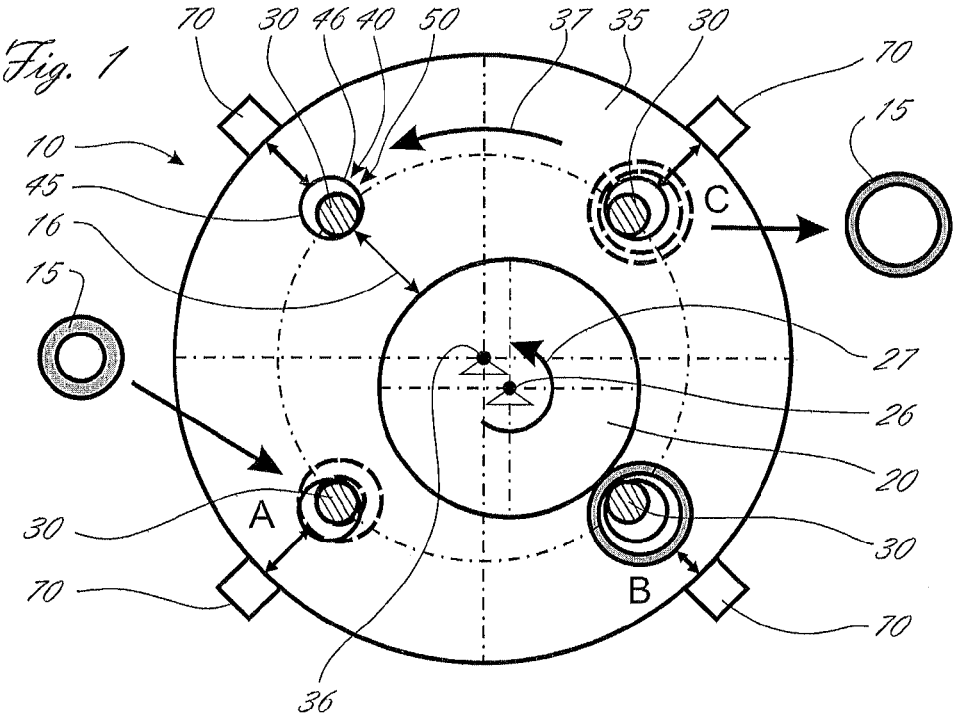
FIG. 1. is a schematic top view of a multi-roll table ring-rolling mill.

The multi-roll table ring-rolling mill 10 shown in the figures comprises, centrally, a main roll 20 that rotates about a main roll axle 26, as well as four mandrel rolls 30, which are mounted on a mandrel roll table 35, which in turn rotates about a mandrel roll table axle 36.

In this connection, the main roll axle 26 and the mandrel roll table axle 36 are offset from one another, so that in this way, an eccentric arrangement of these two axles and of the main roll 20 and of the mandrel roll table 35 is brought about. The corresponding direction of rotation 27 of the main roll 20 about the main roll axle 26 and the direction of rotation 37 of the mandrel roll table 35 or of the mandrel rolls 30 about the mandrel roll table axle 36 are indicated with arrows, in each instance.

The mandrel rolls 30 are mounted on the mandrel roll table 35 with an identical distance from the mandrel roll table axle 36, as such, so that a roll gap 16 between the respective mandrel roll 30 and the main roll 20 periodically changes between a roll gap maximum and a roll gap minimum, as a function of the angular position of the mandrel roll table 35 with reference to the mandrel roll table axle 36 or the main roll 20.

Figure 2:
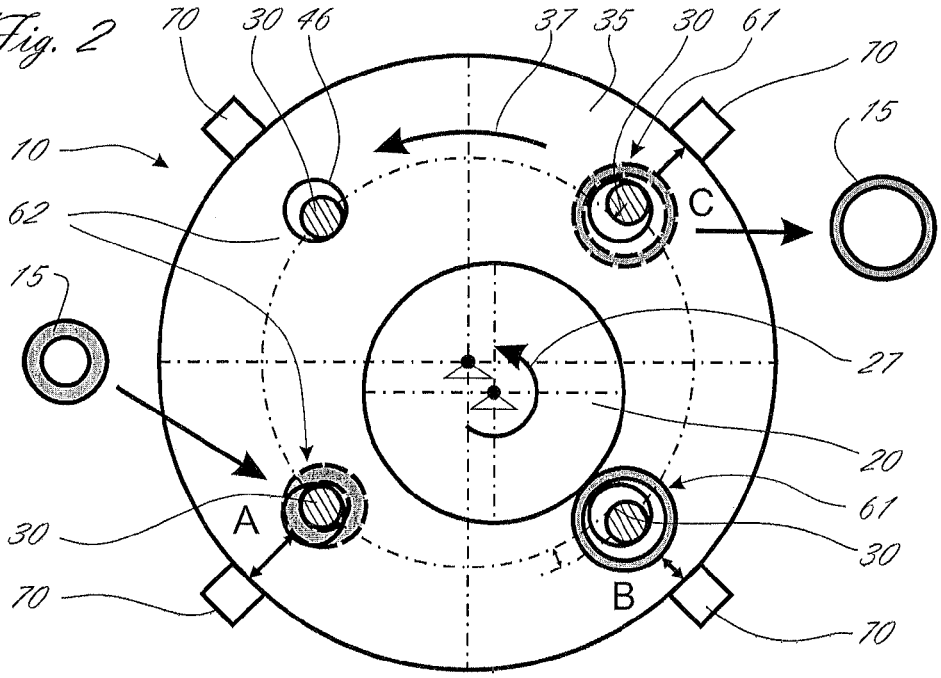
FIG. 2 is a multi-roll table ring-rolling mill according to FIG. 1, with relief of a mandrel roll having taken place.

Furthermore, relief means 40 are provided on the mandrel roll table 35 for each mandrel roll 30, which means are configured as displacement means 45 for the mandrel rolls 30 in this exemplary embodiment, whereby for this purpose, an eccentric device 46, which is individually motor-driven, in each instance, and on which each of the mandrel rolls 30 is mounted, in each instance, is utilized in the embodiment shown in FIGS. 1 and 2. It is understood that this eccentric device 46 can also serve as a return means 50.

Figure 3:
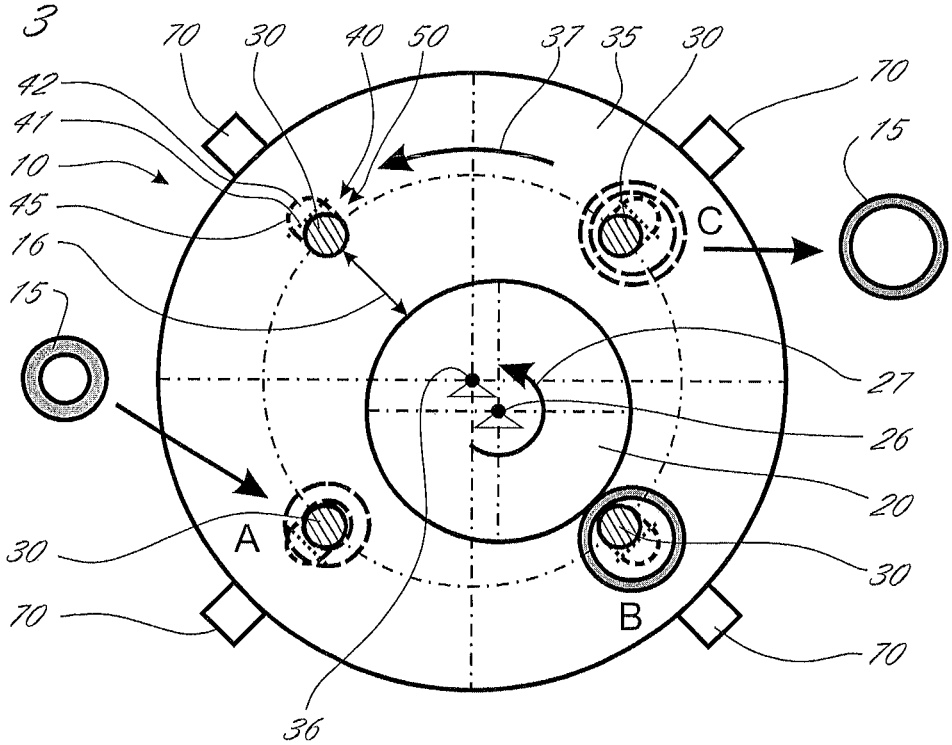
FIG. 3. is a schematic top view of a multi-roll table ring-rolling mill with a mandrel roll lock and the mandrel roll guided in an oblong hole and locked by the mandrel roll lock in all steps.
Figure 4:
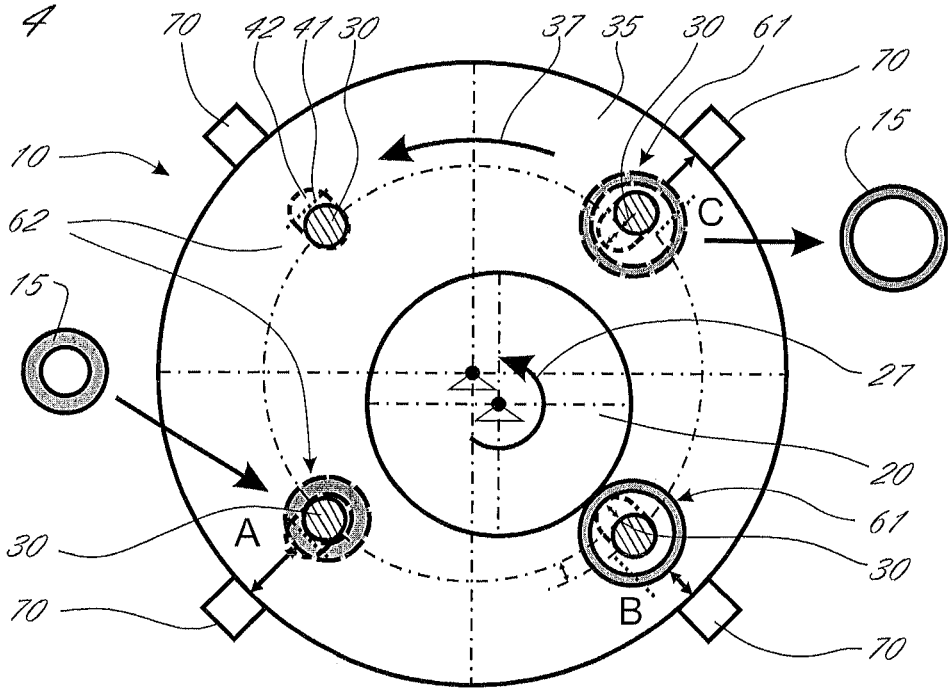
FIG. 4 is a multi-roll table ring-rolling mill according to FIG. 3, with the mandrel roll unlocked by the mandrel lock in steps B and C.

The relief means can comprise a releasable mandrel roll lock 41 of the respective mandrel roll 30 on the mandrel roll table 35 as shown in FIGS. 3 and 4, thereby making it possible to guarantee relief in structurally simple manner, because then, the mandrel roll 30 can be released, and no rolling forces can be applied any longer when the mandrel roll lock 41 is released. For example, it is conceivable to guide the mandrel roll 30 in an oblong hole 42 when the mandrel roll lock 41 is released, whereby the mandrel roll lock 41 can press the mandrel roll against an end of the oblong hole 42 when the mandrel roll 30 is locked in place by it. Accordingly, the mandrel roll lock then absorbs the rolling forces; when the mandrel roll lock is released, this absorption is no longer possible, so that the rolling process is ended.

In the exemplary embodiment shown in FIGS. 1 and 2, the mandrel roll 30 on the eccentric device 46 stands closest to the mandrel roll table axle 36 in a rolling position 62, so that relatively little torque is introduced into the respective eccentric device 46 by rolling forces acting on the mandrel rolls 30. In this regard, it is possible, in the case of this exemplary embodiment, that the electric motor drives of the eccentric devices 46 can counter the rolling forces. It is understood that in deviating embodiments, additional locks, such as engagement devices of the like, can also be provided.

If an eccentric device 46 is rotated about its axis, relative to its rolling position, particularly rotated by 180°, then the respective mandrel roll 30 gets into its release position.

Furthermore, in this exemplary embodiment, measurement means 70 are disposed on the mandrel roll table 35 per mandrel roll 30, which means can measure the outside diameter of rings 15 situated in the roll gap 16 in this exemplary embodiment. In this exemplary embodiment, the measurement means 70 are configured as optical distance measurement devices. It is understood that other measurement means can also be used in modified embodiments.

If a ring 15 is now applied to a mandrel roll 30 (mandrel roll position A), it is rolled out in the narrowing roll gap as the mandrel roll table 35 rotates in the direction of rotation 37, until the roll gap minimum (mandrel roll position B) has been reached. As the mandrel roll table 35 continues to rotate in the direction of rotation 37, the roll gap widens, so that no further rolling takes place, whereby the finished, rolled ring 15 can then be removed from the mandrel roll once again (mandrel roll position C).

As is directly evident, variations in the insertion volume of the ring 15 cause significant variations in the ring diameter with this method management shown in FIG. 1.

For this reason, the respective ring diameter is monitored by way of the measurement means 70, and the respective eccentric device 46 is switched into its release position 61 when a predetermined ring diameter has been reached.

This is checked, in the present exemplary embodiment, by means of a comparison of the respective measurement values with a corresponding, predetermined value.

This switch of the eccentric device 46 or of the mandrel roll 30 into the release position 61 particularly takes place before the roll gap minimum (mandrel roll position B) predetermined by the eccentricity has been reached, whereby a possible switch after the roll gap minimum is not critical, because the rolling process has already been ended here, in any case. When the ring 15 is removed (mandrel roll position C), an eccentric device 46 that is situated in its release position or a mandrel 30 that is situated in its release position 61 is switched back into the rolling position 62. This switch happens in the unstressed state in this exemplary embodiment, whereby in accordance with the present method management, this return step can also take place before or afterward, as long as it is ensured that a rolling process is not initiated or influenced as a result. It is understood that in modified embodiments, the eccentric device 46 can be displaced in the direction of its rolling position even during the rolling process.

Thus, although only a few embodiments of the present invention have been shown and described, it is to be understood that many changes and modifications may be made thereunto without departing from the spirit and scope of the invention.

What is claimed is:

1. A multi-roll table ring-rolling mill comprising:

(a) a mandrel roll table rotating about a mandrel table axle;

(b) at least one main roll rotating about a main roll axle and first and second mandrel rolls mounted in the mandrel roll table; and (c) a relief device for relieving at least the first mandrel roll of rolling forces;

wherein the main roll axle and the mandrel roll table axle are mounted in unchangeable manner and eccentric to one another at least during a rolling process;

wherein the relief device acts independent of the main roll axle and the mandrel roll table axle being eccentric to one another; and wherein the relief device comprises a releasable mandrel roll lock of the first mandrel roll on the mandrel roll table, the releasable mandrel roll lock comprising a snap connection or other engagement device.

2. The multi-roll table ring-rolling mill according to claim 1, further comprising a measurement device for measuring a ring diameter of a ring situated and rolled between the first mandrel roll and the main roll or between the second mandrel roll and the main roll.

3. The multi-roll table ring-rolling mill according to claim 2, wherein the measurement device is connected to act together with the relief device in such a manner that the relief device relieves the first mandrel roll when a specific ring diameter has been reached.

4. The multi-roll table ring-rolling mill according to claim 2, wherein the measurement device is disposed on the mandrel roll table.

5. The multi-roll table ring-rolling mill according to claim 1, further comprising a return device for returning the first mandrel roll from a release position to a rolling position.

6. The multi-roll table ring-rolling mill according to claim 1, further comprising a first measurement device for the first mandrel roll and a second measurement device for the second mandrel roll, wherein the first measurement device measures a ring diameter of a first ring situated and rolled between the first mandrel roll and the main roll and the second measurement device measures a ring diameter of a second ring situated and rolled between the second mandrel roll and the main roll.

7. A rolling method for rolling rings in a multi-roll table ring-rolling mill comprising a mandrel roll table rotating about a mandrel table axle; at least one main roll rotating about a main roll axle and first and second mandrel rolls mounted in the mandrel roll table; and a relief device for relieving at least the first mandrel roll of rolling forces; wherein the main roll axle and the mandrel roll table axle are mounted in unchangeable manner and eccentric to one another at least during a rolling process; wherein the relief device acts independent of the main roll axle and the mandrel roll table axle being eccentric to one another; and wherein the relief device comprises a releasable mandrel roll lock of the first mandrel roll on the mandrel roll table, the releasable mandrel roll lock comprising a snap connection or other engagement device, the rolling method comprising:

(a) rotating the first and second mandrel rolls mounted in the mandrel roll table about the main roll to form a first gap between the first mandrel roll and the main roll and a second gap between the second mandrel roll and the main roll;

(b) reducing to a roll gap minimum each of the first and second gaps as a function of an angular position of the mandrel roll table existing with reference to the main roll;

(c) subsequently increasing the first and second gaps; and (d) when a first predetermined ring diameter is reached for the first mandrel roll, switching the first mandrel roll from a rolling state into a free-running state and when a second predetermined ring diameter is reached for the second mandrel roll, switching the second mandrel roll from a rolling state into a free-running state, wherein the switching takes place even if the roll gap minimum has not yet been reached.

8. The rolling method according to claim 7, wherein to switch the first mandrel roll from the rolling state into the free-running state, the first roll gap of the first mandrel roll is opened.

9. The rolling method according to claim 7, wherein to switch the first mandrel roll from the rolling state into the free-running state, the first roll gap of the first mandrel roll is relieved of rolling force.

10. The rolling method according to claim 7, wherein to switch the first mandrel roll from the rolling state into the free-running state, the first roll gap of the first mandrel roll is opened and the first mandrel roll is relieved of rolling force.

11. The rolling method according to claim 7, wherein after the first or second mandrel roll was switched into the free-running state, the mandrel roll is switched back into the rolling state before commencement of a subsequent rolling process with the first and second mandrel roll, respectively.

12. The rolling method according to claim 7, wherein to switch the first and second mandrel roll from the rolling state into the free-running state, the respective mandrel roll is displaced, with reference to the mandrel roll table, from a rolling position into a release position that is farther away from the main roll than the rolling position.

13. The rolling method according claim 12, wherein after displacement of the first and second mandrel roll from the rolling position into the release position, and before the commencement of the subsequent rolling process with the first and second mandrel roll, respectively, the mandrel roll is displaced back into the rolling position.

14. A multi-roll table ring-rolling mill comprising:

(a) a mandrel roll table rotating about a mandrel table axle;

(b) at least one main roll rotating about a main roll axle and first and second mandrel rolls mounted in the mandrel roll table; and (c) a relief device for relieving at least the first mandrel roll of rolling forces;

wherein the main roll axle and the mandrel roll table axle are mounted in unchangeable manner and eccentric to one another at least during a rolling process;

wherein the relief device acts independent of the main roll axle and the mandrel roll table axle being eccentric to one another;

wherein the relief device comprises a displacement device for displacing a mounting of the first mandrel roll on the mandrel roll table; and wherein the displacement device comprises a motor-driven eccentric device and the first mandrel roll is mounted on the motor-driven eccentric device.

15. The multi-roll table ring-rolling mill according to claim 14, further comprising a measurement device for measuring a ring diameter of a ring situated and rolled between the first mandrel roll and the main roll or between the second mandrel roll and the main roll.

16. The multi-roll table ring-rolling mill according to claim 15, wherein the measurement device is connected to act together with the relief device in such a manner that the relief device relieves the first mandrel roll when a specific ring diameter has been reached.

17. The multi-roll table ring-rolling mill according to claim 15, wherein the measurement device is disposed on the mandrel roll table.

18. The multi-roll table ring-rolling mill according to claim 14, further comprising a return device for returning the first mandrel roll from a release position to a rolling position.

19. The multi-roll table ring-rolling mill according to claim 14, further comprising a first measurement device for the first mandrel roll and a second measurement device for the second mandrel roll, wherein the first measurement device measures a ring diameter of a first ring situated and rolled between the first mandrel roll and the main roll and the second measurement device measures a ring diameter of a second ring situated and rolled between the second mandrel roll and the main roll.

20. A rolling method for rolling rings in a multi-roll table ring-rolling mill comprising a mandrel roll table rotating about a mandrel table axle; at least one main roll rotating about a main roll axle and first and second mandrel rolls mounted in the mandrel roll table; and a relief device for relieving at least the first mandrel roll of rolling forces; wherein the main roll axle and the mandrel roll table axle are mounted in unchangeable manner and eccentric to one another at least during a rolling process; wherein the relief device acts independent of the main roll axle and the mandrel roll table axle being eccentric to one another; wherein the relief device comprises a displacement device for displacing a mounting of the first mandrel roll on the mandrel roll table; and wherein the displacement device comprises a motor-driven eccentric device and the first mandrel roll is mounted on the motor-driven eccentric device, the rolling method comprising:

(a) rotating the first and second mandrel rolls mounted in the mandrel roll table about the main roll to form a first gap between the first mandrel roll and the main roll and a second gap between the second mandrel roll and the main roll;

(b) reducing to a roll gap minimum each of the first and second gaps as a function of an angular position of the mandrel roll table existing with reference to the main roll;

(c) subsequently increasing the first and second gaps; and (d) when a first predetermined ring diameter is reached for the first mandrel roll, switching the first mandrel roll from a rolling state into a free-running state and when a second predetermined ring diameter is reached for the second mandrel roll, switching the second mandrel roll from a rolling state into a free-running state, wherein the switching takes place even if the roll gap minimum has not yet been reached.

21. The rolling method according to claim 20, wherein to switch the first mandrel roll from the rolling state into the free-running state, the first roll gap of the first mandrel roll is opened.

22. The rolling method according to claim 20, wherein to switch the first mandrel roll from the rolling state into the free-running state, the first roll gap of the first mandrel roll is relieved of rolling force.

23. The rolling method according to claim 20, wherein to switch the first mandrel roll from the rolling state into the free-running state, the first roll gap of the first mandrel roll is opened and the first mandrel roll is relieved of rolling force.

24. The rolling method according to claim 20, wherein after the first or second mandrel roll was switched into the free-running state, the mandrel roll is switched back into the rolling state before commencement of a subsequent rolling process with the first and second mandrel roll, respectively.

25. The rolling method according to claim 20, wherein to switch the first and second mandrel roll from the rolling state into the free-running state, the respective mandrel roll is displaced, with reference to the mandrel roll table, from a rolling position into a release position that is farther away from the main roll than the rolling position.

26. The rolling method according claim 25, wherein after displacement of the first and second mandrel roll from the rolling position into the release position, and before the commencement of the subsequent rolling process, with the first and second mandrel roll, respectively, the mandrel roll is displaced back into the rolling position.

* * * * *